US011319623B2

(12) United States Patent
Van Schoonevelt et al.

(10) Patent No.: US 11,319,623 B2
(45) Date of Patent: May 3, 2022

(54) METHOD FOR PRODUCING A STEEL STRIP WITH AN ALUMINIUM ALLOY COATING LAYER

(71) Applicant: TATA STEEL IJMUIDEN B.V., Velsen-Noord (NL)

(72) Inventors: Hugo Van Schoonevelt, IJmuiden (NL); Guido Cornelis Hensen, Haarlem (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 299 days.

(21) Appl. No.: 16/485,655

(22) PCT Filed: Feb. 23, 2018

(86) PCT No.: PCT/EP2018/054599
§ 371 (c)(1),
(2) Date: Aug. 13, 2019

(87) PCT Pub. No.: WO2018/158165
PCT Pub. Date: Sep. 7, 2018

(65) Prior Publication Data

US 2020/0017948 A1 Jan. 16, 2020

(30) Foreign Application Priority Data

Feb. 28, 2017 (EP) ..... 17158418
Feb. 28, 2017 (EP) ..... 17158419

(51) Int. Cl.
*C23C 2/12* (2006.01)
*C21D 1/26* (2006.01)
(Continued)

(52) U.S. Cl.
CPC ..... *C23C 2/12* (2013.01); *C21D 1/26* (2013.01); *C21D 1/42* (2013.01); *C22C 38/001* (2013.01);
(Continued)

(58) Field of Classification Search
None
See application file for complete search history.

(56) References Cited

U.S. PATENT DOCUMENTS 4,624,895 A 11/1986 Nickola
5,066,549 A 11/1991 Kilbane et al.
(Continued)

FOREIGN PATENT DOCUMENTS

CN 1531604 A 9/2009
CN 106133179 A 11/2016
(Continued)

OTHER PUBLICATIONS

International Search Report and Written Opinion dated Jun. 6, 2018 for PCT/EP2018/054599 to Ttata Stffi Ijimuiden B.V. filed Feb. 23, 2018.
(Continued)

*Primary Examiner* — Jenny R Wu
(74) *Attorney, Agent, or Firm* — Vorys, Sater, Seymour and Pease LLP

(57) ABSTRACT

A method for producing a steel strip with an aluminium alloy coating layer in a continuous coating process. Also, a steel strip coated with an aluminium alloy coating layer that can be produced in accordance with the method, the use of such a coated steel strip and the product made by using the coated steel strip.

22 Claims, 8 Drawing Sheets

Figure 1:
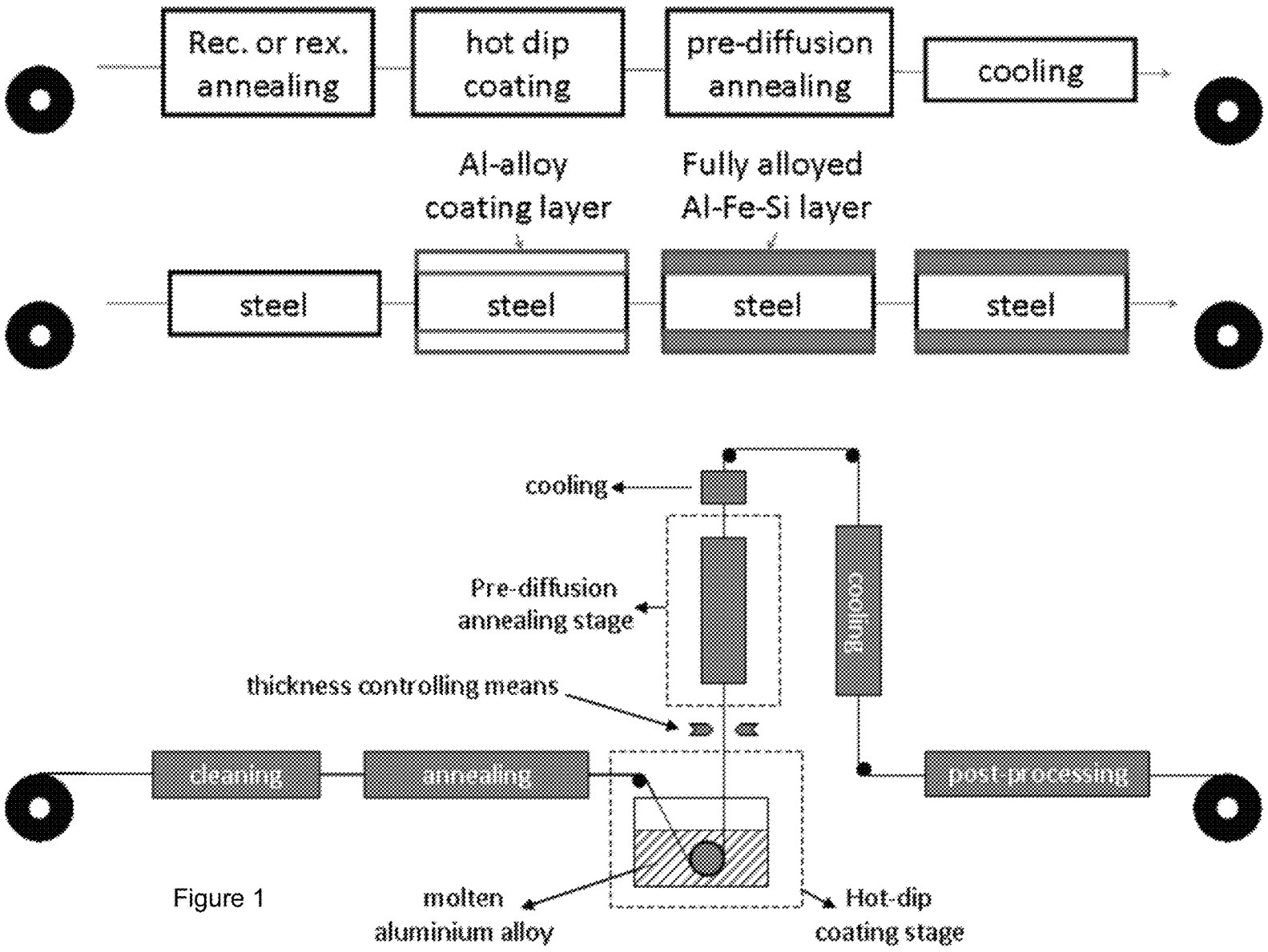

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/54*** | (2006.01) |
| ***C23C 2/28*** | (2006.01) |
| ***C23C 2/40*** | (2006.01) |
| ***C23C 10/00*** | (2006.01) |
| ***C21D 1/42*** | (2006.01) |
| ***C22C 38/32*** | (2006.01) |

(52) U.S. Cl.

CPC ..... *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/32* (2013.01); *C22C 38/54* (2013.01); *C23C 2/28* (2013.01); *C23C 2/40* (2013.01); *C23C 10/00* (2013.01)

(56) References Cited

U.S. PATENT DOCUMENTS

| | | | | |
|---|---|---|---|---|
| 6,296,805 | B1 | 10/2001 | Laurcent et al. | |
| 2014/0205857 | A1* | 7/2014 | Goto | C23C 30/00 428/653 |
| 2016/0145733 | A1 | 5/2016 | Schwartz | |
| 2016/0362764 | A1 | 12/2016 | Sohn et al. | |
| 2016/0376679 | A1 | 12/2016 | Kim et al. | |

FOREIGN PATENT DOCUMENTS

| | | | | | |
|---|---|---|---|---|---|
| CN | 106164317 | A | | 11/2016 | |
| EP | 0971044 | A1 | | 1/2000 | |
| EP | 2377965 | A1 | | 10/2011 | |
| EP | 2818571 | A1 | | 12/2014 | |
| FR | 2565256 | A1 | * | 12/1985 | C23C 2/12 |
| JP | 2012255204 | A | * | 12/2012 | |
| JP | 2012255204 | A | | 12/2012 | |
| JP | 2014118628 | A | | 6/2014 | |
| JP | 2015131995 | A | | 7/2015 | |
| WO | 2009095427 | A1 | | 8/2009 | |
| WO | 2014019020 | A1 | | 2/2014 | |
| WO | 2015039763 | A2 | | 3/2015 | |
| WO | 2016146581 | A1 | | 9/2016 | |
| WO | 2018158166 | A1 | | 9/2018 | |

OTHER PUBLICATIONS

Espacenet Bibliography of 4,624,895 to Nickola from European Patent Office, URL: <https://worldwide.espacenet.com/patent/search/family/024472152/publication/US4624895A?q=US4624895>, retrieved Jan. 19, 2022.

Maksteel, Other Metals, URL: <https://www.maksteel.com/other-metals/>, retrieved from the Internet Jan. 19, 2022.

Indian Office Action dated Jan. 13, 2022 in Indian Application No. 201947038244.

* cited by examiner

Sample A Sample B

A. Sample A

B. Sample B

METHOD FOR PRODUCING A STEEL STRIP WITH AN ALUMINIUM ALLOY COATING LAYER

CROSS-REFERENCE TO RELATED APPLICATIONS

This is a § 371 National Stage Application of International Application No. PCT/EP2018/054599 filed on Feb. 23, 2018, claiming the priority of European Patent Application Nos. 17158418.8 and 17158419.6 filed on Feb. 28, 2017.

The invention relates to a method for producing a steel strip with an aluminium alloy coating layer in a continuous coating process. The invention also relates to an steel strip coated with an aluminium alloy coating layer that can be produced in accordance with the method, the use of such a coated steel strip and the product made by using the coated steel strip.

It is known in the art to use an aluminium-silicon alloy for coating a steel strip for producing hot-formed articles. One of the early patent applications filed in this respect is EP0971044. It has been found in practice that the products produced by hot-forming of blanks cut from this aluminium-silicon coated steel strip suppress scale formation during the hot-forming process, due to the presence of the aluminium-silicon coating. The prior art aluminium-silicon coating contains about 9 to 10 wt. % silicon. It is noted that when reference is made to an aluminium-silicon coating, a.k.a. an Al—Si coating, that Al and Si are deemed characteristic elements, but that other elements may be, and usually are, present in the coating as well. By means of non-limiting example: due to the high temperature of the coating process and the hot-forming process iron will dissolve from the steel substrate into the coating.

However, despite its use in hot-forming processes, it has also been found that during the hot-forming process the aluminium-silicon coating melts at about 575° C. when the coated blank is heated to a temperature above the Ac1 temperature of the steel, causing sticking of the molten aluminium-silicon to transport rolls in the radiation oven in which the blanks are heated. Because of the high reflectivity of these coatings for thermal radiation the blanks only heat up slowly, and therefore a long time is needed for the coating to saturate with iron by diffusion from the steel substrate. This is exacerbated by the melting of the coating which further increases the reflectivity.

Several attempts have been made to solve these problems. For instance, EP2240622 discloses that a coil of aluminium-silicon coated steel can be heated in a bell type annealing furnace during several hours at a certain temperature to achieve alloying of the coating with iron. EP2818571 discloses that a coil of aluminium-silicon coated steel is placed on a decoiler, and the strip is transported through a furnace at a certain temperature and during a certain time period to achieve alloying of the coating with iron. After this pre-diffusion blanks can be produced from the pre-diffused strip. However, both these methods require an additional process step, addition use of apparatus, additional time and additional energy. For these reasons, the alloying of the strip or blanks before heating in the hot-forming furnace is not used in practice.

It is an object of the invention to provide a method for producing an aluminium-alloy coated steel strip which is easy and cost-effective to use, and which provides an aluminium-alloy coating that does not stick to transport rolls during use in a furnace for hot-forming.

It is a further object of the invention to provide a method for producing aluminium-alloy coated steel strip by which the blanks can be heated fast in the hot-forming furnace.

It is another object of the invention to provide a method for producing an aluminium-alloy coated steel strip that can be implemented in existing production lines.

It is another object of the invention to provide an improved aluminium-alloy coated steel strip for use in a hot-forming process.

It is moreover an object of the invention to provide the use of the above mentioned steel strip to in a hot-forming process.

It is furthermore an object of the invention to provide the product resulting from the use of the steel strip according to the invention.

One or more of these objects can be reached with the invention according to claims 1 and 12. Preferred embodiments are provided in the dependent claims.

The inventors believe that the prior art aluminium-silicon coating is difficult to alloy with iron due to the high silicon content in the aluminium coating. This is primarily caused by the formation of an inhibition layer on the steel interface during dipping of the steel strip in the bath of molten aluminium alloy. The inventors have found that when the silicon amount in the coating is lowered according to the invention that such an inhibition layer is not formed or, if it is present, it is only partly formed, and will not substantially prevent the diffusion of the iron into the aluminium-alloy coating layer. Compared to the prior art aluminium-silicon layers the diffusion of iron is therefore not impeded at all, or only to a relatively ineffective extent.

After experimentation, the inventors have found that a silicon content of between 0.4 and 4.0% (all percentages are in weight percent (wt. %) unless otherwise indicated) in the aluminium alloy coating layer must be used to allow the diffusion of iron into the aluminium-alloy coating in the pre-diffusion annealing stage immediately following the coating of the steel strip with the aluminium alloy coating layer. The diffusion can then be performed within a short time of at most 40 seconds, and in this time period the iron from the steel strip will have diffused over the full thickness of the coating. The time has to be short to enable fitting the annealing cycle into existing lines or line concepts. The diffusion should take place at an annealing temperature between 600 and 800° C., so the diffusion of iron in the liquid aluminium alloy coating layer will be fast. After dipping the steel strip in the molten aluminium alloy the outer layer of the coated steel strip exiting the bath of molten aluminium alloy is still liquid. So the annealing temperature is above the melting temperature of the aluminium alloy coating layer. In the pre-diffusion annealing stage the diffusion of iron from the steel strip into the aluminium alloy coating layer is promoted to form a fully-alloyed aluminium-iron-silicon, substantially entirely consisting of iron-aluminides with silicon as in solid solution. The diffusion annealing can be performed quickly after the continuous coating without the need to provide any substantial cooling or heating between the hot-dip coating stage and the pre-diffusion annealing stage because the annealing temperature is preferably in the same range as the temperature for continuous coating. The pre-diffusion annealing stage must be executed while the applied coating layer is still liquid to enable the fast diffusion of iron into the coating layer. The diffusion of iron in an already solidified coating layer would be much too slow. The slow diffusion of iron into a solidified aluminium alloy coating layer is one of the reasons why the heating stage in the conventional hot-forming process takes so long. The high reflectivity of the solidified coating is the other contributing factor. The incorporation of the pre-diffusion annealing stage in the continuous coating and annealing line as depicted in FIG. 1A allows the diffusion annealing to take place quickly, because of the molten state of the coating layer, and it does not require an additional process step of reheating and cooling, because it is integrated in the continuous coating line. Such an additional process step would also have the disadvantages of having to start the diffusion from an already solidified coating layer, so this process would suffer from the same problems as the heating up stage in a hot-forming process (reflectivity, slow diffusion). The process according to the invention can be integrated in existing lines, because it goes so fast, and thus requires relatively little space, capital expenditure and operational costs.

The composition of the fully alloyed coating layer after the pre-diffusion annealing stage consists substantially entirely of iron-aluminides with silicon in solid solution. There may be insignificant amounts of other components in the microstructure but these do not adversely affect the properties of the fully-alloyed aluminium-iron-silicon coating layer which is obtained in the method according to the invention after the pre-diffusion annealing stage. The intention is that the fully alloyed coating layer after the pre-diffusion annealing stage consists entirely of iron-aluminides with silicon in solid solution, and that thus a fully alloyed aluminium-iron-silicon coating layer or layers is/are obtained.

In the method according to the invention the strip is not cooled to ambient temperatures between the hot-dip coating stage and the pre-diffusion annealing stage. Preferably there is no active cooling whatsoever between the hot-dip coating stage and the pre-diffusion annealing stage. The strip may have to be reheated to the pre-diffusion annealing temperature of between 600 and 800° C. to compensate for the cooling of the strip after leaving the bath and the cooling effect of the thickness controlling means, such as air knives. Only after the pre-diffusion annealing stage the strip is cooled to ambient temperature. This cooling usually takes place in two steps, wherein the cooling immediately after the annealing is intended to prevent any sticking or damage of the fully-alloyed coating layer to turning rolls, and is usually executed with an air or mist cooling at a cooling rate of about between 10 and 30° C./s and further on in the line the strip with the fully-alloyed Al—Fe—Si coating layer is cooled quickly, usually by quenching in water. It is noted that the effect of the cooling is largely thermal to prevent damage to the line and the fully alloyed Al—Fe—Si coating layer, and that the effect of the cooling on the properties of the steel substrate are negligible.

The minimum silicon content of the aluminium alloy coating layer is 0.4 wt. %. Below 0.4% there is an increased risk of forming a finger-like interface between the initial alloy layer after the hot dipping stage and the remnants of the as yet unalloyed aluminium alloy coating layer still having the composition of the molten aluminium alloy due to irregular growth of the alloy layer. Above 0.4% this irregular growth is avoided. Above 4.0% Si the closed inhibition layer formed on the interface makes rapid alloying impossible.

The low silicon content in the aluminium alloy coating layer (0.4-4.0 wt. % Si) according to the invention as compared to the prior art aluminium-silicon coating layer (9-10 wt. % Si) enables the full alloying to be completed in a timeframe which is sufficiently short (at most 40 seconds) for it to enable implementation in existing hot-dip coating lines.

Figure 8:
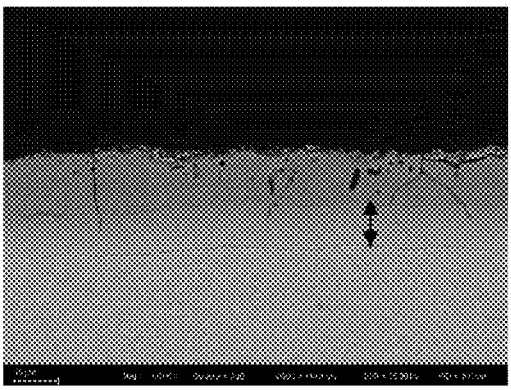
Figure 8:
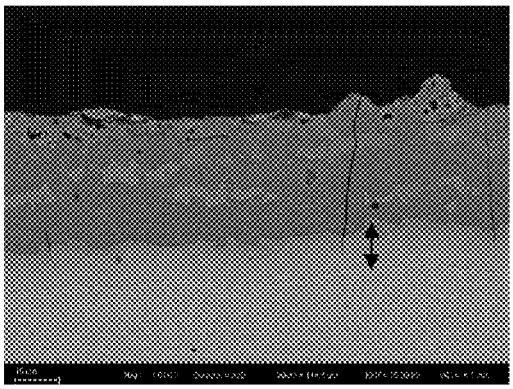

The fully-alloyed aluminium-iron-silicon coating layer after the pre-diffusion annealing stage can also be referred to as a pre-diffused aluminium-iron-silicon coating layer, because the required diffusion of the iron into the aluminium alloy coating layer and the saturation with iron has already taken place. In the prior art process this iron diffusion and the formation of the iron-aluminide has to take place during the heating stage before the hot forming step, and therefore this prior art heating stage is considerably longer than the heating stage required when using the pre-diffused aluminium-iron-silicon coating layer according to the invention. It should be noted that the heating stage of the forming step, which heats to a higher temperature (typically between 850 and 950° C.) for a longer time (typically in the order of 4 to 10 minutes) than the pre-diffusion annealing stage (600 to 800° C. for at most 40 seconds) results in a change in the structure of the coated strip irrespective of whether the strip is a fully alloyed Al—Fe—Si coating layer or a freshly dipped and still un-alloyed coating layer. As soon as the coating layer is saturated with Fe the Al starts to diffuse into the steel substrate, thereby enriching the steel with Al. As soon as sufficient Al has diffused into the steel substrate, the surface layer of the steel substrate remains ferritic during hot forming. This layer of high Al-ferrite is very ductile and prevents any cracks in the aluminium alloy coating layer from reaching the steel substrate. Examples of this ductile layer of high Al-ferrite are shown in FIG. 8.

There are two variants of hot forming: direct and indirect hot stamping. The direct process starts with a coated blank that is heated and formed, while the indirect process uses a preformed component from a coated blank that is subsequently heated and cooled to obtain the desired properties and microstructure after cooling. In the direct method a steel blank is heated in a furnace to a temperature sufficiently high for the steel to transform into austenite, hot-forming it in a press and cooling it to obtain the desired final microstructure of the product. The inventors found that the method according to the invention is very well suited to be used to coat a steel strip of any steel grade that results in improved properties after the cooling of the hot-formed product. Examples of these are steels that result in a martensitic microstructure after cooling from the austenitic range at a cooling rate exceeding the critical cooling rate. However, the microstructure after cooling may also comprise mixtures of martensite and bainite, mixtures of martensite, retained austenite and bainite, mixtures of ferrite and martensite, mixtures of martensite, ferrite and bainite, mixtures of martensite, retained austenite, ferrite and bainite, or even ferrite and very fine pearlite. The fully-alloyed aluminium-iron-silicon coating layer protects the steel strip against oxidation during heating, hot-forming and cooling, and provides adequate paint adhesion to and corrosion protection of the final formed product to be used in, e.g., automotive applications.

The steel strip may be a hot-rolled strip, or a cold-rolled strip. Preferably the steel is a full hard cold-rolled steel strip. Prior to the immersion in the molten aluminium alloy the full hard cold-rolled strip may have been subjected to a recrystallisation annealing or a recovery annealing. If the strip was subjected to a recrystallisation annealing or a recovery annealing then it is preferable that this recrystallisation or recovery annealing is continuous and hot-linked to the hot-dip coating stage. The thickness of the steel strip is typically between 0.4 and 4.0 mm, and preferably at least 0.7 and/or at most 3.0 mm.

The coated steel strip according to the invention provides good protection against oxidation during the hot forming on the one hand, and provides excellent paint adhesion of the finished part on the other. It is important that if there is τ-phase present in the surface layer that it is present in the form of embedded islands, i.e. a dispersion, and not as a continuous layer. A dispersion is defined as a material comprising more than one phase where at least one of the phases (the dispersed phase) consists of finely divided phase domains embedded in the matrix phase. The improvement of the paint adherence is the result of the absence or the limited presence of τ-phase which the inventors found to be responsible for the bad adhesion of the known coatings. Within the context of this invention, a phase is considered to be a τ-phase is the composition is in the following range $Fe_xSi_yAl_z$, phase with a composition range of 50-70 wt. % Fe, 5-15 wt. % Si and 20-35 wt. % Al. τ-phase form when the solubility of silicon is exceeded as a result of the diffusion of iron into the aluminium layer. As a result of the enrichment with iron, the solubility of silicon is exceeded and τ-phase, such as $Fe_2SiAl_2$, form. This occurrence imposes restrictions to the duration of the annealing and the height of the annealing temperature during the hot-forming process. So the formation of τ-phase can be easily avoided or restricted primarily by controlling the silicon content in the aluminium alloy layer on the steel strip or sheet and secondarily by the annealing temperature and time. The added advantage of this is that the duration of the blanks in the furnace can be reduced as well, which may allow shorter furnaces, which is an economical advantage. The combination of annealing temperature and time for a given coating layer is easily determined by simple experimentation followed by routine microstructural observation (see below in the examples). It should be noted that the percentage of τ-phase is expressed in area %, because the surface fraction is measured on a cross section of the coating layer. Preferably the coating layer is free from τ-phase. Because of the influence of the presence of Y-phase on paint adhesion, it is preferable that there is no τ-phase in the coating layer, or at least no τ-phase in the outermost surface layer where the paint would be in contact with the coating layer.

Contiguity (C) is a property used to characterize microstructure of materials. It quantifies the connected nature of the phases in a composite and can be defined as the fraction of the internal surface of an α phase shared with other α phase particles in an α-β two-phase structure. The contiguity of a phase varies between 0 and 1 as the distribution of one phase in the other changes from completely dispersed structure (no α-α contacts) to a fully agglomerated structure (only α-α contacts). The interfacial areas can be obtained using a simple method of counting intercepts with phase boundaries on a polished plane of the microstructure and the contiguity can be given by the following equations:

$$C_\alpha = \frac{2N_L^{\alpha\alpha}}{2N_L^{\alpha\alpha} + N_L^{\alpha\beta}}$$

$$C_\beta = \frac{2N_L^{\beta\beta}}{2N_L^{\beta\beta} + N_L^{\alpha\beta}}$$

where Cα and Cβ are the contiguity of the α and β phases, $N_L^{\alpha\alpha}$ and $N_L^{\beta\beta}$ are the number of intercepts of α/α and β/β interfaces, respectively, with random line of unit length, and $N_L^{\alpha\beta}$ is the number of α/β interfaces with a random line of unit length. With a contiguity $C_\alpha$ of 0, there are no α-grains touching other α-grains. With a contiguity $C_\alpha$ or 1, all α-grains touch other α-grains, meaning that there is just one big lump of α-grains embedded the β-phase.

Preferably the contiguity of the τ-phase, if present, in the surface layer is less than $C_\tau$ is ≤0.4. In an embodiment of the invention the composition of the fully-alloyed aluminium-iron-silicon coating layer is 50-55 wt. % Al, 43-48 wt. % Fe, 0.4-4 wt. % Si and inevitable elements and impurities consistent with the hot dip coating process. It is noted that some elements are known to be added to the melt for specific reasons: Ti, B, Sr, Ce, La, and Ca are elements used to control grain size or modify the aluminium-silicon eutectic. Mg and Zn can be added to the bath to improve corrosion resistance of the final hot-formed product. As a result, these elements may also end up in the aluminium alloy coating layer and consequently also in the fully-alloyed aluminium-iron-silicon coating layer. Elements like Mn, Cr, Ni and Fe will also likely be present in the molten aluminium alloy bath as a result of dissolution of these elements from the steel strip passing through the bath, and thus may end up in the aluminium alloy coating layer. A saturation level of iron in the molten aluminium alloy bath is typically between 2 and 3 wt. %. So in the method according to the invention the aluminium alloy coating layer typically contains dissolved elements from the steel substrate such as manganese, chromium and iron up to the saturation level of these elements in the molten aluminium alloy bath.

In an embodiment of the invention the molten aluminium alloy contains between 0.4 and 4.0 wt. % silicon, and the molten aluminium alloy bath is kept at a temperature between its melting temperature and 750° C., preferably at a temperature of at least 660° C. and/or of at most 700° C. Preferably the temperature of the steel strip entering the molten aluminium alloy is between 550 and 750° C., preferably at least 660° C. and/or at most 700° C. This enables the strip to pass from the hot-dip coating stage to the pre-diffusion annealing stage without substantial heating or cooling, and preferably without any active cooling between the hot-dip coating stage and the pre-diffusion annealing stage. Active heating will only be required to compensate for any loss in temperature due to passive cooling after leaving the bath and due to the (unintended) cooling effect of the thickness controlling means. The temperature in the pre-diffusion annealing stage is between 600 and 800° C., preferably at least 630, more preferably at least 650° C. and/or at most 750° C. Typically the temperature in the pre-diffusion annealing stage is between 680 and 720° C.

In a preferred embodiment the steel strip is led through the hot-dip coating stage and the pre-diffusion annealing stage at a velocity v of between 0.6 m/s and 4.2 m/s, preferably of at most 3.0 m/s, more preferably a velocity of at least 1.0 and/or at most 2.0 m/s. These speeds are industrial speeds for a hot-dip coating line, and the method according to the invention allows maintaining this production speed.

In an embodiment the aluminium alloy coating layer contains at least 0.5 wt. % Si, preferably at least 0.6 wt. % Si, or even 0.7 or 0.8 wt. %. In an embodiment the aluminium alloy coating layer contains at most 3.5, preferably at most 3.0 wt. % Si, or even at most 2.5 wt. %.

In an embodiment the aluminium alloy coating layer contains 1.6 to 4.0 wt. % silicon, preferably at least 1.8 wt. % and/or at most 3.5, 3.0 or 2.5 wt. % silicon. This embodiment is particularly suitable for thin coating layers, typically of below 20 μm.

In another embodiment the aluminium alloy coating layer contains 0.4 to 1.4 wt. % silicon, preferably 0.5 to 1.4 wt. % silicon, more preferably 0.7 to 1.4 wt. % silicon. A suitable maximum value is 1.3 wt. % silicon. This embodiment is particularly suitable for thicker coating layers, typically of 20 μm or thicker.

Preferably the thickness of the aluminium alloy coating layer is at least 10 and/or at most 40 μm, preferably at least 12 μm, more preferably at least 13 μm, preferably at most 30, more preferably at most 25 μm. There is a balance between the thickness of the coating layer in terms of alloying costs on the one hand and the speed of the annealing process and resistance to oxidation at the other. The inventors found that the ranges above allow for a balanced choice. The optimal window from this point of view is between 15 and 25 μm. Furthermore it should be noted that the thickness on one side of the steel strip may be different from the thickness on the other side, and in an extreme case there may be only an aluminium alloy coating layer on one side of the steel strip and none on the other. However, this takes additional precautions during the hot-dip coating, and therefore the normal case will be that there is an aluminium alloy coating layer on both sides, optionally with different thicknesses.

In a preferred embodiment the thickness d (in μm) of the fully-alloyed aluminium-iron-silicon coating layer in dependence of the silicon content (in wt. %) of the fully-alloyed aluminium-iron-silicon coating layer is enclosed in the Si-d space by the equations (1), (2) and (3):

$$d \geq -1.39 \cdot Si + 12.6 \text{ and} \quad (1)$$

$$d \leq -9.17 \cdot Si + 43.7 \text{ and} \quad (2)$$

$$Si \geq 0.4\%. \quad (3)$$

The higher the silicon content, the lower the thickness d of the coating layer, and the smaller the operational window.

In a preferred embodiment the annealing time in the pre-diffusion annealing stage is at most 30 seconds. The shorter the annealing time, the shorter the annealing means in the pre-diffusion annealing stage, and therefore the lower the capital and operational costs to install. Preferably the annealing means comprise, or consist of, an induction type furnace. This type of heating is quick, clean and reactive. There is no complicated furnace atmosphere to be maintained which would be the case when burners are used. Also the environmental impact of induction furnaces is lower in comparison to other types of furnace. Contact heating or resistance heating may achieve the same benefits. An additional advantage of induction heating and resistance heating is that the heat is generated in the strip and therefore comes from within, which is beneficial to promote the iron diffusion from the steel strip into the aluminium-alloy coating layer. Alternative furnaces to induction, or in addition thereto, may be radiant tube furnaces, direct fire furnaces or electrically heated furnaces, or mixtures thereof. Preferably the annealing time in the pre-diffusion annealing stage is at least 2 and preferably at least 5 seconds, and preferably at most 25 seconds. A typical minimum annealing time is 10 seconds, a typical maximum annealing time is 20 seconds. The entrance of the pre-diffusion annealing stage is as close to the aluminium alloy coating layer thickness controlling means, such as air knives, as practically possible because the pre-diffusion annealing stage must be executed while at least the outer layer of the aluminium alloy coating layer is still liquid. Practically, the entrance of the pre-diffusion annealing stage will be about 0.5 to 5.0 m after the thickness controlling means.

The time of the immersion of the steel strip in the molten aluminium alloy bath is between 2 and 10 seconds. A longer time requires a very deep bath or complicated trajectory therein, or a very slow running line, which is all undesired, whereas there must be sufficient time to build up the layer thickness. A typical minimum immersion time is 3 s, and a typical maximum is 6 s.

Upon exiting the molten aluminium alloy bath, the thickness of the aluminium layer on the steel strip is controlled by thickness controlling means, such as air knives which blow air, nitrogen or another suitable gas at high pressure through a nozzle slit onto the freshly dipped steel strip. By altering the pressure, the distance from the steel strip or the height of the nozzles over the molten aluminium alloy the coating thickness can be adjusted depending on the requirements.

In an embodiment of the invention the steel strip has a composition comprising (in wt. %)

| | | |
|---|---|---|
| C: 0.01-0.5 | P: ≤0.1 | Nb: ≤0.3 |
| Mn: 0.4-4.0 | S: ≤0.05 | V: ≤0.5 |
| N: 0.001-0.030 | B: ≤0.08 | Ca: ≤0.05 |
| Si: ≤3.0 | O: ≤0.008 | Ni ≤2.0 |
| Cr: ≤4.0 | Ti: ≤0.3 | Cu ≤2.0 |
| Al: ≤3.0 | Mo: ≤1.0 | W ≤0.5 |

the remainder being iron and unavoidable impurities. These steels allow very good mechanical properties after a hot-forming process, whereas during the hot forming above Ac1 or Ac3 they are very formable. Preferably the nitrogen content is at most 0.010%. It is noted that any one or more of the optional elements may also be absent. i.e. either the amount of the element is 0 wt. % or the element is present as an unavoidable impurity.

In a preferred embodiment the steel strip has a composition comprising (in wt. %)

| | | |
|---|---|---|
| C: 0.10-0.25 | P: ≤0.02 | Nb: ≤0.3 |
| Mn: 1.0-2.4 | S: ≤0.005 | V: ≤0.5 |
| N: ≤0.03 | B: ≤0.005 | Ca: ≤0.05 |
| Si: ≤0.4 | O: ≤0.008 | Ni ≤0.05 |
| Cr: ≤1.0 | Ti: ≤0.3 | Cu ≤0.05 |
| Al: ≤1.5 | Mo: ≤0.5 | W ≤0.02 |

the remainder being iron and unavoidable impurities. Preferably the nitrogen content is at most 0.010%. Typical steel grades suitable for hot forming are given in table A.

TABLE A

Typical steel grades suitable for hot forming.

| Steel | C | Si | Mn | Cr | Ni | Al | Ti | B | N | $C_{eq}$ |
|---|---|---|---|---|---|---|---|---|---|---|
| B-A | 0.07 | 0.21 | 0.75 | 0.37 | 0.01 | 0.05 | 0.048 | 0.002 | 0.006 | 0.148 |
| B-B | 0.16 | 0.40 | 1.05 | 0.23 | 0.01 | 0.04 | 0.034 | 0.001 | — | 0.246 |
| B-C | 0.23 | 0.22 | 1.18 | 0.16 | 0.12 | 0.03 | 0.04 | 0.002 | 0.005 | 0.320 |

TABLE A-continued

Typical steel grades suitable for hot forming.

| Steel | C | Si | Mn | Cr | Ni | Al | Ti | B | N | $C_{eq}$ |
|---|---|---|---|---|---|---|---|---|---|---|
| B-D | 0.25 | 0.21 | 1.24 | 0.34 | 0.01 | 0.03 | 0.042 | 0.002 | 0.004 | 0.350 |
| B-E | 0.33 | 0.31 | 0.81 | 0.19 | 0.02 | 0.03 | 0.046 | 0.001 | 0.006 | 0.400 |
| N-A | 0.15 | 0.57 | 1.45 | 0.01 | 0.03 | 0.04 | 0.003 | — | 0.003 | 0.243 |
| N-B | 0.14 | 0.12 | 1.71 | 0.55 | 0.06 | 0.02 | 0.002 | — | — | 0.258 |
| N-C | 0.19 | 0.55 | 1.61 | 0.02 | 0.05 | 0.04 | 0.003 | — | 0.006 | 0.291 |
| N-D | 0.20 | 1.81 | 1.48 | 0.04 | 0.03 | 0.04 | 0.006 | — | — | 0.337 |

According to a third aspect of the invention the fully-alloyed aluminium-iron-silicon coated steel strip according the invention is used to produce a hot-formed product in a hot-forming process. Because the steel according the invention has undergone the diffusion process already, i.e. it is pre-diffused, the absence of any liquid layers during the heating up stage in the hot forming process allows for a cleaner process without sticking risks. Also, the reflectivity of the fully-alloyed aluminium-iron-silicon coated steel strip is much lower than that of the prior art (with 10 wt. % Si) aluminium-silicon coated steel strip, leading to faster heating of blanks if a radiation furnace is used, and thus to potentially fewer or smaller reheating furnaces, and less damage of the product and pollution of the equipment due to roll build-up.

In addition, the hot-formed coated steel product provides better paint adhesion, and the reheating of the steel prior to hot forming can be performed by induction heating. Induction heating a prior art aluminium-silicon coated steel strip with 10 wt. % Si will lead to a bad surface quality, because the outer layer of these steels will be liquid during the reheating of the steel in the heating furnace of the hot-forming line. The liquid layer will react to the induction field and become wavy, rather than smooth. With the fully-alloyed aluminium-iron-silicon coated steel strip according to the invention the diffusion of iron has already happened in the pre-diffusion annealing stage so the total annealing time in the heating furnace of the hot-forming line is further reduced in addition to the faster heat-up rate due to the lower reflectivity of the fully-alloyed aluminium-iron-silicon coated steel strip.

In FIG. 1 the process according to the invention is summarised. The steel strip is passed through an optional cleaning section to remove the undesired remnants of previous processes such as scale, oil residue etc. The clean strip is then led though the optional annealing section, which in case of a hot rolled strip may only be used for heating the strip to allow hot-dip coating (so-called heat-to-coat cycle) or in case of a cold-rolled strip may be used for a recovery or recrystallisation annealing. After the annealing the strip is led to the hot-dip coating stage where the strip is provided with the aluminium-alloy coating layer according to the invention. Thickness control means for controlling the thickness of the aluminium-alloy coating layer are schematically shown disposed between the hot-dip coating stage and the subsequent pre-diffusion annealing stage. In the pre-diffusion annealing stage the aluminium-alloy coating layer is transformed into the fully-alloyed aluminium-iron-silicon layer after which the coated strip is post-processed (such as optional temper rolling or tension levelling) before being coiled.

EXAMPLES

The invention will now be further explained by means of the following, non-limitative examples. The steel substrate for the experiments had the composition as given in Table 1.

TABLE 1

Composition of steel substrate, balance Fe and inevitable impurities. 1.5 mm, cold-rolled, full-hard condition.

| C wt. % | Mn wt. % | Cr wt. % | Si wt. % | P wt. % | S wt. % | Al wt. % | B ppm | Ca ppm |
|---|---|---|---|---|---|---|---|---|
| 0.20 | 2.18 | 0.64 | 0.055 | 0.010 | 0.001 | 0.036 | 0 | 17 |

Example 1

Two aluminium-alloy coated steels were produced. Sample A was produced by hot-dipping a steel strip in a molten aluminium alloy bath comprising 0.9 wt. % Si. Sample B was produced by hot-dipping in a prior art aluminium alloy bath comprising 9.6 wt. % Si. Both baths were saturated with Fe (about 2.8 wt. %). The steel grade used is a 1.5 mm cold rolled steel, in full hard condition and having a composition suitable for hot forming applications. Prior to hot-dipping the steels were recrystallisation annealed. Immediately following the recrystallisation annealing the steels were immersed in the respective aluminium alloy bath fora period of 3 seconds, which is consistent with a line speed of about 120 m/min. The strip entry temperature in the bath was 680° C., and the bath temperature was 700° C. After hot dipping the layer thickness of the coating was adjusted by wiping with nitrogen gas at 20 μm. The steels were annealed in the pre-diffusion annealing stage for 20 s at 700° C. to obtain pre-alloying and then cooled down by forced nitrogen gas.

Figure 2:
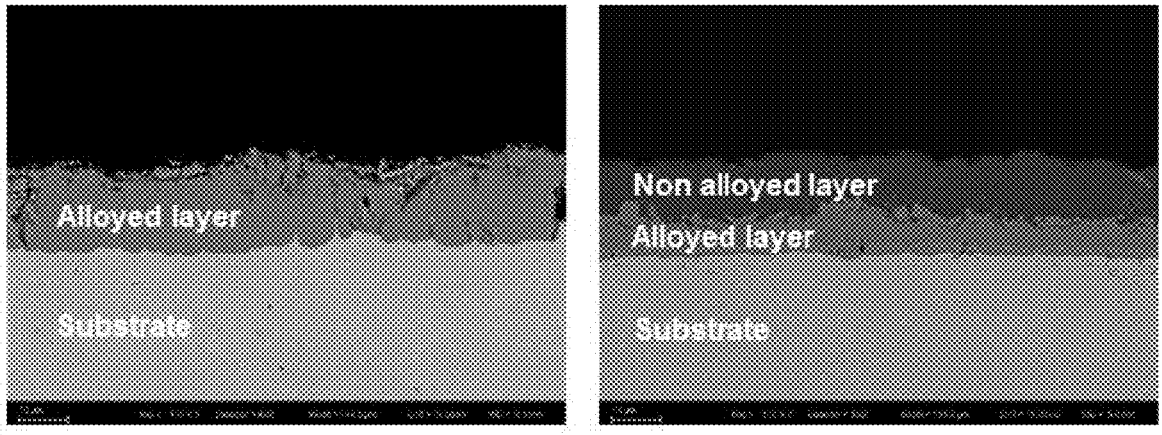

FIG. 2 shows the annealed aluminium-alloy coating layers. The coating on sample A is a fully-alloyed aluminium-iron-silicon coating layer while the coating on sample B consists of an alloyed layer of less than 10 μm thick (with a different composition than the fully-alloyed aluminium-iron-silicon coating layer on sample A!) with a non-alloyed layer with the coating bath composition on top. Additional experiments with sample B with varying annealing times in the pre-diffusion annealing stage at 700° C. show that the growth rate of the alloyed layer is very slow (see table 1). The remainder of the coating layer is still liquid.

TABLE 1 thickness measurements of alloy layer on Sample B annealed at 700° C.

| Sample ID | i | ii | iii | iv |
|---|---|---|---|---|
| Heat treatment time [s] | 0 | 10 | 20 | 60 |
| Alloy layer thickness [μm] | 5 | 7 | 9 | 11 |

So a prior art coating with 9.6 wt. % Si is not suitable for inline pre-alloying according to the invention, because the pre-diffusion annealing stage does not produce a fully-alloyed aluminium-iron-silicon coating layer. The coating with 0.9% Si on the other hand shows a fully alloyed layer of 20 μm thickness already after 20 seconds.

Example 2

Figure 3:
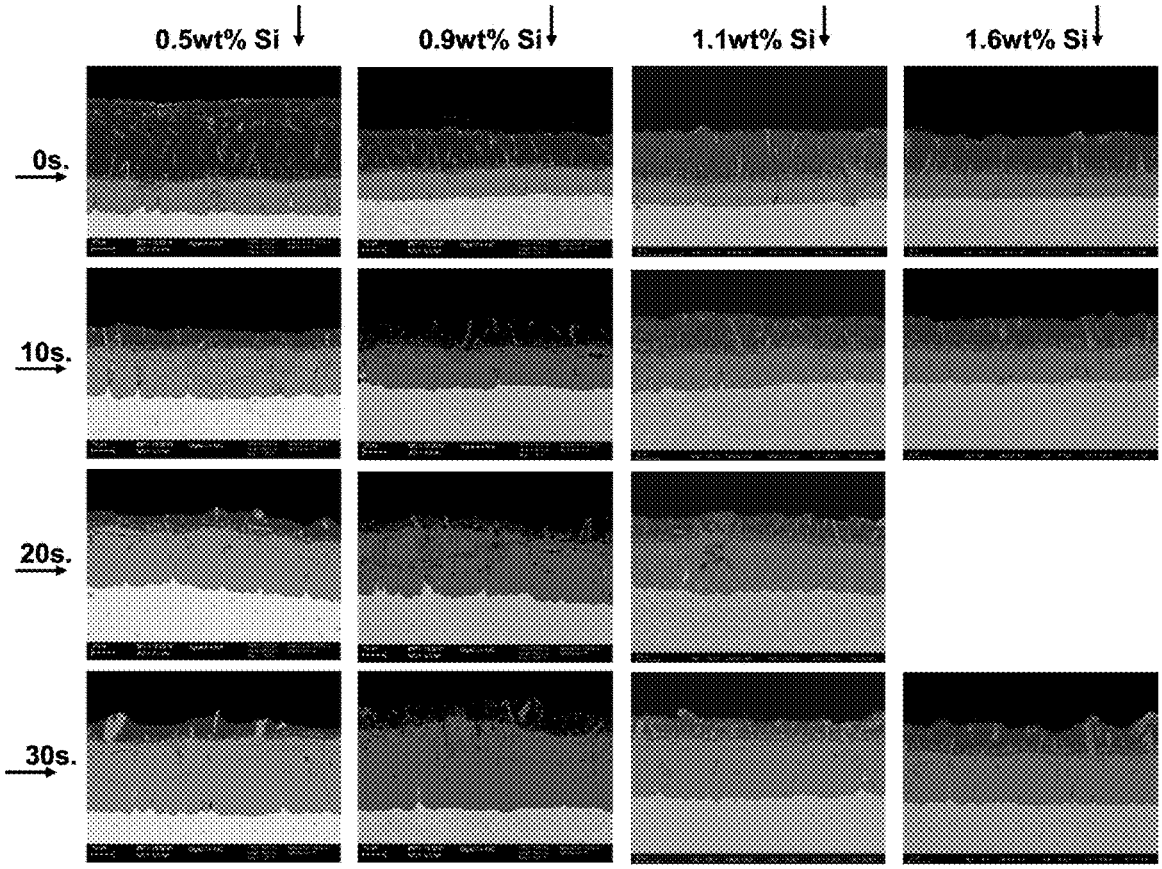
Figure 4:
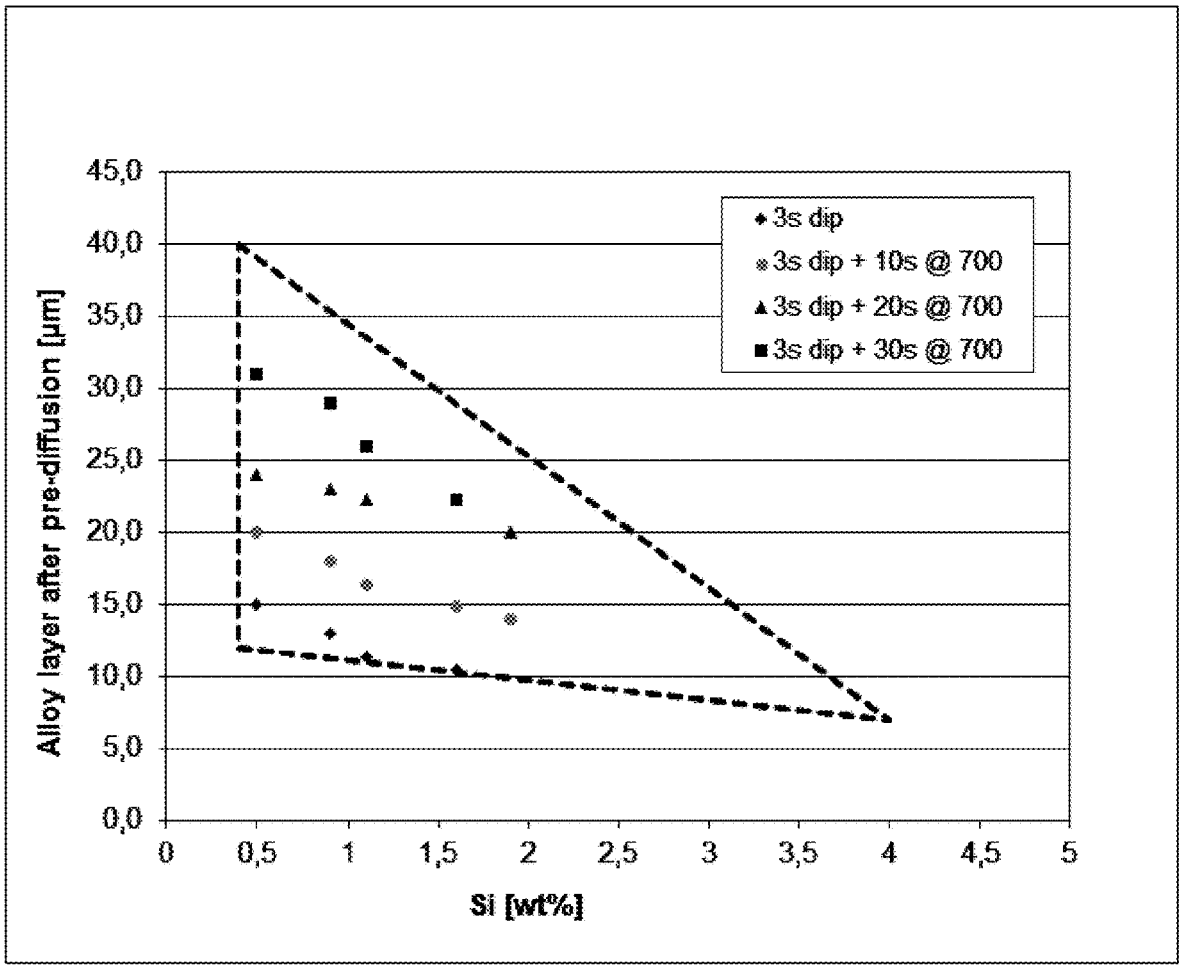

Sample A from Ex. 1 (recrystallised cold-rolled 1.5 mm thick strip) was hot-dip coated in aluminium-alloy baths with different Si concentrations according to the invention, varying between 0.5, 0.9, 1.1 and 1.6 wt. % and pre-diffusion annealing times ranged from 0 to 30 seconds. The pre-diffusion annealing temperature was 700° C. The coating layer thickness was adjusted at 30 to 40 μm by nitrogen jets after exiting the coating bath. Producing relatively thick layers was a deliberate choice as the purpose of these examples was to determine the maximum achievable pre-alloying thickness without a limiting effect of the applied coating thickness. The steels were treated the same as in Ex. 1, except for the varying annealing time. In FIG. 3 cross sections (SEM) of the produced coatings are shown. The images clearly reveal an increased alloy layer thickness at lower Si levels and longer heat treatment times. Alloy layer thickness are presented in FIG. 4. Measurements demonstrate that depending on Si concentration and heat treatment time the alloy layer thickness ranges from 10 to 35 μm. Based on the measurements and extrapolation of the measurements a triangle is drawn in FIG. 4 that displays the thickness of fully alloyed coatings that can be produced with dipping times of 3 s in combination with heat times between 0 and 30 s.

Example 3

Hot-forming steel (1.5 mm) coated with an aluminium alloy coating layer with 0.9 wt. % Si and 2.3 wt. % Fe with immersion times in the molten aluminium alloy bath of 3, 5 and 10 seconds. After exiting the coating bath the layers thickness was controlled at 25 μm by wiping with nitrogen. Next the steels were cooled down with forced nitrogen. Bath and strip entry temperature were as before. The thickness of the alloy layer thicknesses are given in table 2. The increase of alloy layer thickness at longer dipping times, i.e. lower line speeds, is clearly illustrated.

TABLE 2 thickness measurements (0.9 wt. % Si)

| Sample ID | v | vi | vii |
|---|---|---|---|
| Dipping time[s] | 3 | 5 | 10 |
| Alloy layer thickness [μm] | 13 | 15 | 18 |

Figure 5:
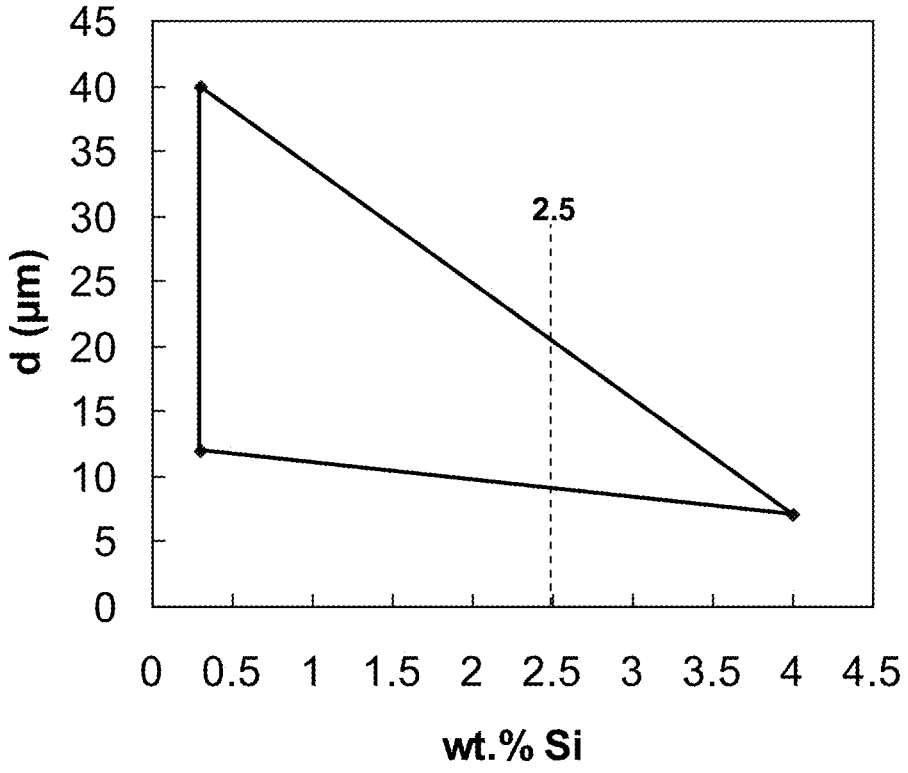

By changing the dipping time the fabrication window of Ex. 3 (FIG. 4) can be enlarged. Combining data of both examples resulted in a production window of fully alloyed coatings as shown in FIG. 5.

Example 4

Hot-forming steel (1.5 mm) coated with an aluminium alloy coating layer with 1.9 wt. % Si and 2.3 wt. % Fe with immersion times in the molten aluminium alloy bath of 3, 5 and 10 seconds. After exiting the coating bath the layers thickness was controlled at 25 μm by wiping with nitrogen. Next the steels were cooled down with forced nitrogen. Bath and strip entry temperature were as before. The thickness of the alloy layer thicknesses are given in table 3. The increase of alloy layer thickness at longer dipping times, i.e. lower line speeds, is clearly illustrated.

TABLE 3 thickness measurements in μm (1.9 wt. % Si)

| pre-diffusion annealing time (s) | Dipping time 3 s | Dipping time 5 s | Dipping time 10 s |
|---|---|---|---|
| 0 | 9 | 10 | 12 |
| 10 | 14 | 16 | 18 |
| 20 | 20 | 21 | 23 |

Example 5

Figure 6:
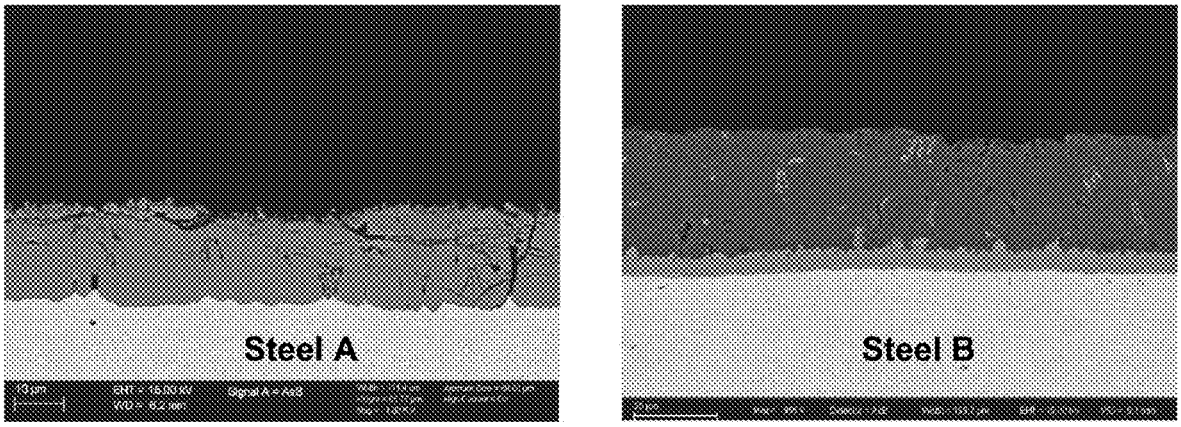
Figure 7:
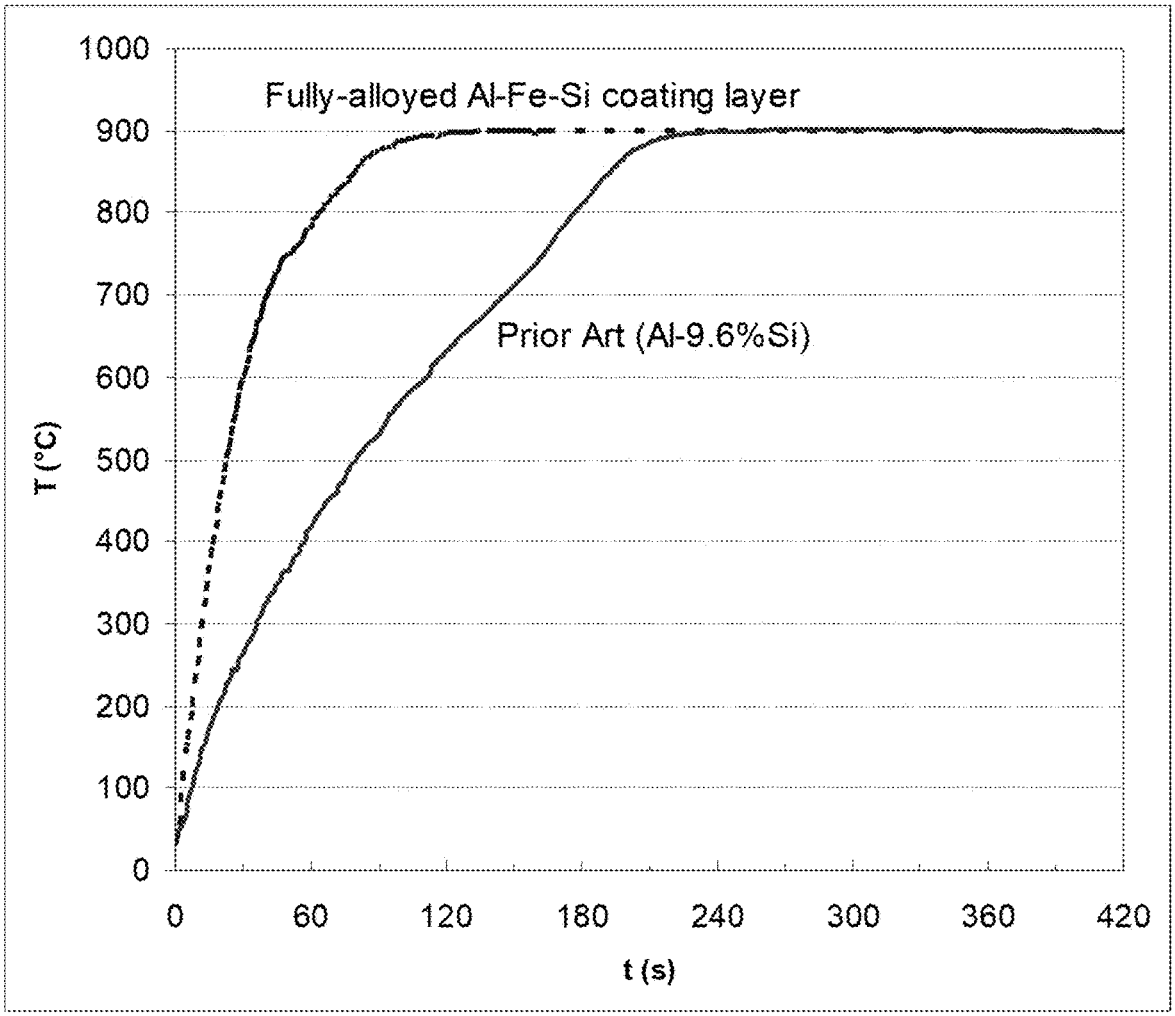

The layer structure of sample A after pre-diffusion annealing (for 20 s at 700° C., according to the invention) and B as hot-dipped (so no pre-diffusion annealing, which is the prior art situation) are compared in FIG. 6 (SEM cross section images). Sample A shows a fully-alloyed aluminium-iron-silicon coating layer, whereas the coating on sample B is a thin alloy layer at the steel interface, while the top part of the coating is not alloyed and has an average composition equal to the coating bath composition. As a consequence the top layer starts to melt at a temperature of about 575° C. The steels in this condition were heat treated in a radiation furnace set at 900° C. with a thermocouple welded to the strips to record the heat-up rates. The heating curves of both steels (see FIG. 7) clearly illustrate the faster heat up rate of the pre-alloyed sample A compared to comparative sample B. Especially at lower temperatures the heating rate is improved by pre-alloying as during this stage the reflection of radiation is markedly reduced by the dull appearance of the pre-alloyed coating. Faster heating rate enables higher throughput with the same furnace. Alternatively shorter furnaces can be used requiring a smaller foot print and lower investment. Samples taken at temperatures of 700, 800, 850° C. during the heating of sample B revealed that only at after reaching a temperature of 850° C. a fully alloyed layer is obtained. This means that the outer part of the coating layer remained liquid over the entire temperature range of 575 to 850° C. During the time the coating is molten roll build up during contact with the furnace rolls occur. Roll build up not only leads to increased maintenance and furnace down time but is also a source of product damage. Sample A with the non-melting pre-alloyed coating is not causing any roll build up at any temperature.

Example 6

Sample A (1.1 wt. % Si) and sample B sheets (9.6 wt. % Si) were heated in a radiation furnace set at 900° C. At various time intervals samples were taken out of the furnace for examination in cross section to determine the growth rate of the diffusion layer. A thickness of the diffusion layer of 10 μm is considered to be a proper diffusion zone with good crack propagation resistance. The investigation showed that a thickness of this thickness was achieved for sample A after 170 seconds at 900° C. and for sample B after 400 s. With sample A (according to the invention) a furnace time saving of more than 50% is achieved compared to sample B (prior art). The relevant images are shown as FIGS. 8A and B.

The invention claimed is:

1. A method for producing a steel strip coated on one or both sides with an aluminium alloy coating layer in a continuous hot-dip coating and a subsequent pre-diffusion annealing process, said process comprising:

a hot-dip coating stage in which the steel strip is passed with a velocity v through a bath of a molten aluminium alloy to apply an aluminium alloy coating layer to one or both sides of the steel strip, and a pre-diffusion annealing stage, wherein the thickness of the applied aluminium alloy coating layer on the one or both sides of the steel strip is between 5 and 40 μm and wherein the aluminium alloy coating layer comprises 0.8 to 4.0 weight % silicon, and wherein the aluminium alloy coated steel strip enters the pre-diffusion annealing stage while at least the outer layer of the aluminium alloy coating layer or layers is above its liquidus temperature, and the strip is annealed at an annealing temperature of at least 600 and at most 800° C. for 10 to 40 seconds to promote the diffusion of iron from the steel strip into the aluminium alloy coating layer or layers to form a substantially fully-alloyed aluminium-iron-silicon coating layer or layers, substantially consisting of iron-aluminides;

followed by cooling the pre-diffusion annealed coated steel strip to ambient temperatures, wherein the velocity v is between 0.6 m/s and 4.2 m/s.

2. The method according to claim 1, wherein the composition of the fully-alloyed aluminium-iron-silicon coating layer or layers is 50-55 wt. % Al, 43-48 wt. % Fe, 0.8-4 wt. % Si and inevitable elements and impurities, wherein Zn content and/or Mg content in the bath is below 1.0 wt. %.

3. The method according to claim 1, wherein the molten aluminium alloy in the bath contains between 0.8 and 4.0 wt. % silicon, and wherein the molten aluminium alloy has a temperature of between 630 and 750° C.

4. The method according to claim 3, wherein the temperature of the steel strip entering the molten aluminium alloy bath is between 550 and 750° C.

5. The method according to claim 1, wherein the fully-alloyed aluminium-iron-silicon coating layer contains at least 0.9 wt. % Si and at most 3.5 wt. % Si.

6. The method according to claim 1, wherein the thickness of the fully-alloyed aluminium-iron-silicon coating layer is 8 to 40 μm.

7. The method according to claim 1, wherein the thickness d in μm of the fully-alloyed aluminium-iron-silicon coating layer in dependence of the silicon content in wt. % of the fully-alloyed aluminium-iron-silicon coating layer is enclosed in an Si-d space by the equations (1), (2) and (3):

(1) $d \geq -1.39 \cdot Si + 12.6$ and (2) $d \leq -9.17 \cdot Si + 43.7$ and (3) $Si \geq 0.8\%$.

8. The method according to claim 1, wherein the annealing time in the pre-diffusion annealing stage is 10 to 25 seconds.

9. The method according to claim 1, wherein immersion time of the steel strip in the molten aluminium alloy bath in the hot-dip coating stage is between 2 and 10 seconds.

10. The method according to claim 1, wherein the steel strip has a composition comprising (in wt. %):

| | | |
|---|---|---|
| C: 0.01-0.5 | P: ≤0.1 | Nb: ≤0.3 |
| Mn: 0.4-4.0 | S: ≤0.05 | V: ≤0.5 |
| N: ≤0.001-0.030 | B: ≤0.08 | Ca: ≤0.05 |
| Si: ≤3.0 | O: ≤0.008 | Ni ≤2.0 |
| Cr: ≤4.0 | Ti: ≤0.3 | Cu ≤2.0 |
| Al: ≤3.0 | Mo: ≤1.0 | W ≤0.5 |

the remainder being iron and unavoidable impurities, and wherein the composition of the fully-alloyed aluminium-iron-silicon coating layer or layers is 50-55 wt. % Al, 43-48 wt. % Fe, 0.8-4 wt. % Si and inevitable elements and impurities.

11. The method according to claim 1, wherein the molten aluminium alloy in the bath contains between 0.8 and 4.0 wt. % silicon, and wherein the molten aluminium alloy has a temperature of at least 660° C. and at most 700° C., wherein Zn content and/or Mg content in the bath is below 1.0 wt. %.

12. The method according to claim 3, wherein the temperature of the steel strip entering the molten aluminium alloy bath is at least 660° C. and at most 700° C.

13. The method according to claim 3, wherein the velocity v is 1.0 to 2.0 m/s.

14. The method according to claim 1, wherein the thickness of the fully-alloyed aluminium-iron-silicon coating layer is 10 to 30 μm.

15. The method according to claim 1, wherein the thickness of the fully-alloyed aluminium-iron-silicon coating layer is 12 to 25 μm.

16. The method according to claim 1, wherein the thickness of the fully-alloyed aluminium-iron-silicon coating layer is 5 to 20 μm.

17. The method according to claim 9, wherein the immersion time of the steel strip in the molten aluminium alloy bath in the hot-dip coating stage is 3 to 6 seconds.

18. The method according to claim 1, wherein Zn content and Mg content in the bath is below 1.0 wt. %.

19. The method according to claim 18, wherein there is an absence of τ-phase in the coating layer.

20. The method according to claim 18, wherein if there is any τ-phase in the coating layer Contiguity of the τ-phase $C_\tau < 0.4$.

21. The method according to claim 18, wherein the fully-alloyed aluminium-iron-silicon coating layer or layers contain between 0 and 10 area % τ-phase, and wherein the τ-phase, if present, is dispersed in the coating layer such that Contiguity of the τ-phase $C_\tau < 0.4$.

22. The method according to claim 18, wherein the composition of the substantially fully-alloyed aluminium-iron-silicon coating layer or layers consists of 50-55 wt. % Al, 43-48 wt. % Fe, 0.8-4 wt. % Si, optionally Ti, B, Ce, La, Zn, Mn, Cr, Ni and inevitable elements.

* * * * *